US010486228B2

(12) United States Patent
Sowka et al.

(10) Patent No.: US 10,486,228 B2
(45) Date of Patent: Nov. 26, 2019

(54) METHOD AND DEVICE FOR THIN-SLAB STRAND CASTING

(71) Applicants: ThyssenKrupp Steel Europe AG, Duisburg (DE); ThyssenKrupp AG, Essen (DE)

(72) Inventors: Eberhard Sowka, Dinslaken (DE); Frank Spelleken, Dinslaken (DE); Andy Rohe, Dinslaken (DE); Helmut Osterburg, Rheinberg (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 136 days.

(21) Appl. No.: 15/303,179

(22) PCT Filed: Apr. 15, 2015

(86) PCT No.: PCT/EP2015/058130
§ 371 (c)(1),
(2) Date: Oct. 10, 2016

(87) PCT Pub. No.: WO2015/162039
PCT Pub. Date: Oct. 29, 2015

(65) Prior Publication Data

US 2017/0036267 A1 Feb. 9, 2017

(30) Foreign Application Priority Data

Apr. 25, 2014 (DE) ..... 10 2014 105 870

(51) Int. Cl.
*B22D 11/12* (2006.01)
*B22D 11/16* (2006.01)

(52) U.S. Cl.
CPC ..... *B22D 11/122* (2013.01); *B22D 11/16* (2013.01)

(58) Field of Classification Search
CPC ..... B22D 11/122; B22D 11/16
See application file for complete search history.

(56) References Cited

U.S. PATENT DOCUMENTS 4,515,203 A * 5/1985 Narita ..... B22D 11/122 164/468
4,637,453 A 1/1987 Ayata et al.
(Continued)

FOREIGN PATENT DOCUMENTS

DE 2810491 A1 9/1979
DE 3322891 A1 1/1985
(Continued)

OTHER PUBLICATIONS

JPO machine translation of JP 2001-087846 (Year: 2001).*
(Continued)

*Primary Examiner* — Kevin E Yoon
(74) *Attorney, Agent, or Firm* — The Webb Law Firm

(57) ABSTRACT

A method for continuous casting of thin slabs may involve feeding a molten metal into a mold, molding a partially solidified thin-slab strand from the molten metal in the mold, reducing a flow rate of the molten metal in the partially solidified thin-slab strand by way of an electromagnetic brake positioned in a region of the mold, and removing the partially solidified thin-slab strand from the mold by way of a strand guiding system. Unsolidified parts of the partially solidified thin-slab strand may be stirred by an electromagnetic stirrer arranged underneath the mold downstream along a strand takeoff direction of the thin-slab strand. Further, a traveling electromagnetic field may be produced by the electromagnetic stirrer in a region of the thin-slab strand that is at a distance from the mold of between 20 and 7000 millimeters along the strand takeoff direction.

15 Claims, 1 Drawing Sheet

(56) References Cited

U.S. PATENT DOCUMENTS

Figure 1:
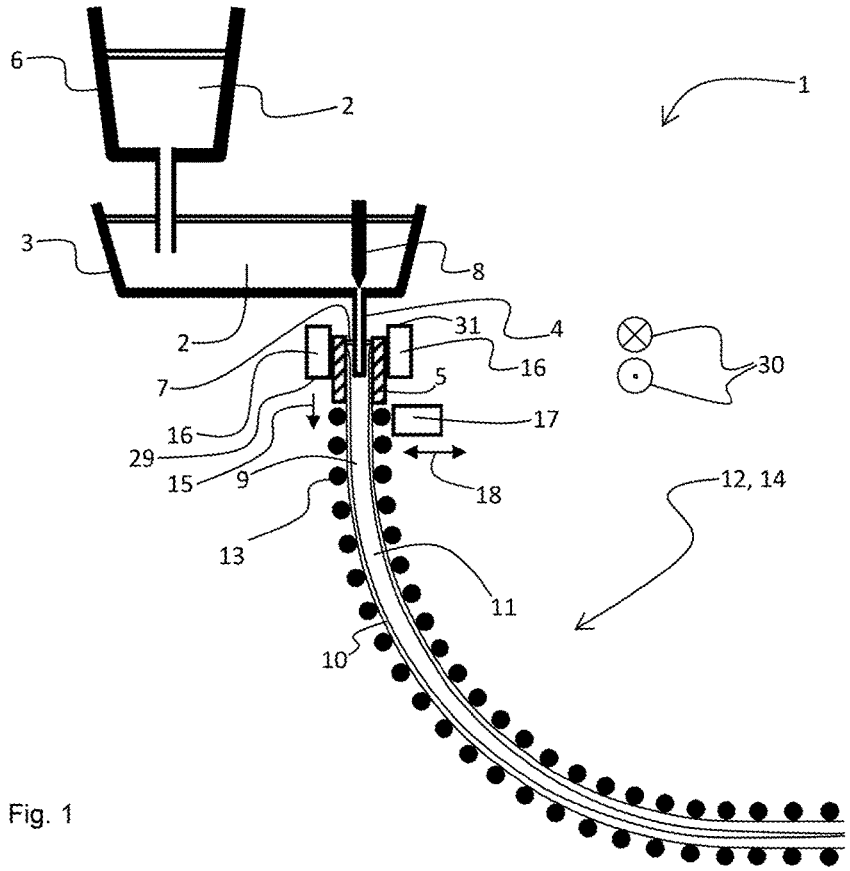

| | | | | |
|---|---|---|---|---|
| 5,381,857 | A * | 1/1995 | Tozawa | B22D 11/115 164/466 |
| 2012/0012274 | A1 | 1/2012 | Okada et al. | |

FOREIGN PATENT DOCUMENTS

| | | | | | |
|---|---|---|---|---|---|
| DE | 19542211 | A1 | | 5/1997 | |
| DE | 10020703 | A1 | | 10/2001 | |
| DE | 10350076 | A1 | | 6/2005 | |
| DE | 69824749 | T2 | | 8/2005 | |
| DE | 102009056000 | A1 | | 3/2011 | |
| DE | 212009000056 | U1 | | 4/2011 | |
| EP | 0010041 | A1 | | 4/1980 | |
| EP | 0092126 | A1 | | 10/1983 | |
| GB | 2019273 | A | | 10/1979 | |
| GB | 2061783 | A | * | 5/1981 | B01F 13/0809 |
| JP | 60162559 | A | * | 8/1985 | B22D 11/122 |
| JP | 63049352 | A | * | 3/1988 | B22D 11/122 |
| JP | H08323454 | A | | 12/1996 | |
| JP | 2001-087846 | A | | 4/2001 | |
| JP | 3180164 | B2 | | 6/2001 | |
| JP | 2003326339 | A | | 11/2003 | |
| JP | 2011-101895 | A | | 5/2011 | |

OTHER PUBLICATIONS

EPO machine translation of JP 08-323454 (Year: 1996).*
"Improved quality and productivity in slab casting by electromagnetic braking and stirring," C. Crister et al., 41st Steelmaking Seminar International, Resende, Brazil, May 23-26, 2010, pp. 1-15.
Int'l Search Report for PCT/EP2015/058130 dated Jun. 11, 2015 (dated Jun. 24, 2015).
English Language Abstract for DE69824749.
English Language Abstract for DE212009000056.
English Language Abstract for DE102009056000.
Wikipedia "Dünnbrammengießen".
Machine translation of Wikipedia excerpt "Dünnbrammengießen".
English language Abstract for JP 2001-087846 A listed above.
English language Abstract for JP 3180164 B2 listed above.
English language Abstract for JP 2011-101895 A listed above.
English language Abstract for DE 10350076 A1 listed above.
English language Abstract for DE 3322891 A1 listed above.
English language Abstract for EP 0010041 A1 listed above.
Bin et al.,Theory and Technology of Electromagnetic Stirring for Continuous Casting Steels, Metallurgical Industry Press, Jan. 2012, pp. 281-286, 1st Edition, Beijing.
Yong, Practical Handbook for Modern Continuous Steel Casting, Metallurgical Industry Press, Mar. 2010, pp. 916-918, 1st Edition, Beijing.

* cited by examiner

METHOD AND DEVICE FOR THIN-SLAB STRAND CASTING

CROSS REFERENCE TO RELATED APPLICATIONS

This application is a U.S. National Stage Entry of International Patent Application Serial Number PCT/EP2015/058130, filed Apr. 15, 2015, which claims priority to German Patent Application No. DE 10 2014 105 870.4 filed Apr. 25, 2014, the entire contents of both of which are incorporated herein by reference.

FIELD

The present disclosure relates to methods for the continuous casting of thin slabs.

BACKGROUND

It is generally known from the prior art to produce thin slabs by the continuous casting method. This involves producing a molten metal, which is transferred into a tundish by means of a steel casting ladle. From the tundish, the molten metal flows by way of a casting tube into a mold, which is cooled and moved in an oscillating manner. In the mold there forms from the molten metal a strand with a solidified shell and a mostly not yet solidified cross section within the solidified shell. When it leaves the mold, the strand is taken up by a transporting system with a multiplicity of strand guiding rollers, between which the strand is passed through the so-called casting bow and is cooled down until it has solidified through completely. It is also known to slow down the flow rate of the molten metal inside the already partially solidified strand within the mold by means of an electromagnetic brake (EMBR). The aim here is to reduce the flow rate of the molten steel at the bath level and make the bath level profile more uniform, in order to improve the lubrication between the strand and the mold and reduce strand surface defects that may be caused by casting slag becoming entrapped.

For producing the thin slabs with thicknesses of between 40 and 120 millimeters, the mold typically has in the upper part a cross section that is widened in the form of a funnel and in the lower part a cross section that is rectangular. On account of these small thicknesses, the solidifying-through times in the case of thin-slab continuous casting are relatively short and the proportion of liquid material inside the partially solidified strand is low. This inevitably results in a coarse, highly directional, columnar crystalline microstructure in the continuous casting of thin slabs. Such a microstructure may however have disadvantageous effects on the quality of the surface and the interior of the products produced from the thin slabs. For example, depending on the grade of steel and the casting conditions, longitudinal striations on the product surface, inhomogeneous mechanical properties, microstructural stringers, core segregations, reduced HIC resistance (Hydrogen Induced Cracking) and internal crack susceptibilities may occur on the products produced from the thin slab material.

It is known from conventional thick-slab continuous casting to avoid longitudinal striations in the case of dynamo steels by casting with very low overheating. In the case of thick-slab continuous casting, however, there is a comparatively long solidifying-through time, so that overheatings of the molten steel in the tundish below about 12 kelvins are sufficient to achieve adequate microstructural refinement.

The microstructural refinement can be described as adequate if the extent of the globular core zone in the thickness direction is more than 30%. In order to achieve the same effect in the case of thin slabs, the shorter solidifying-through times mean that such a low overheating would have to be chosen that casting problems in the form of clogging of the immersion tubes in the mold would occur, which could result in strand surface defects or even strand ruptures.

It is also known from the specialist literature (for example "Improved quality and productivity in slab casting by electromagnetic braking and stirring", C. Crister et al., 41st Steelmaking Seminar International, Resende, Brazil, May 23-26, 2010, pages 1-15) that electromagnetic stirrers are used in some thick-slab continuous casting installations for the refinement of the solidification structure. The stirrers are installed here either in the region of the mold or several meters below the bath level of the mold.

The document DE 698 24 749 T2 also discloses a device for casting metal which comprises a mold for forming a cast strand and means for feeding a primary flow of hot molten metal to the mold. The device concerned has a magnetic system which applies a static or periodic magnetic field to the flow of the metal in the unsolidified parts of the cast strand, in order to act on the molten metal in the mold during the casting. This is intended to brake and divide up the flow of the hot metal, in order to achieve a secondary flow pattern in the mold. It is additionally known from this document to provide a further device in the form of an electromagnetic stirrer, in order to act on the molten material in the mold or on the molten material downstream of the mold. However, in this document it is not disclosed in which region with respect to the mold the electromagnetic stirrer is to be arranged.

The use of an electromagnetic brake and/or an electromagnetic stirrer in the continuous casting of steel is also known for thick-slab formats from the documents DE 21 2009 000 056 U1 and DE 10 2009 056 000 A1.

Electromagnetic stirrers have not so far been used in the continuous casting of thin slabs. The particular difficulty in thin-slab continuous casting is that of achieving a significant microstructural refinement with the short solidifying-through times in comparison with thick-slab continuous casting and the small-volume proportion of liquid inside the strand. The present invention solves this problem.

BRIEF DESCRIPTION OF THE FIGURES AND TABLES

FIG. 1 is a schematic sectional view of an example device for the continuous casting of thin slabs.

Figures 2A, 2B:
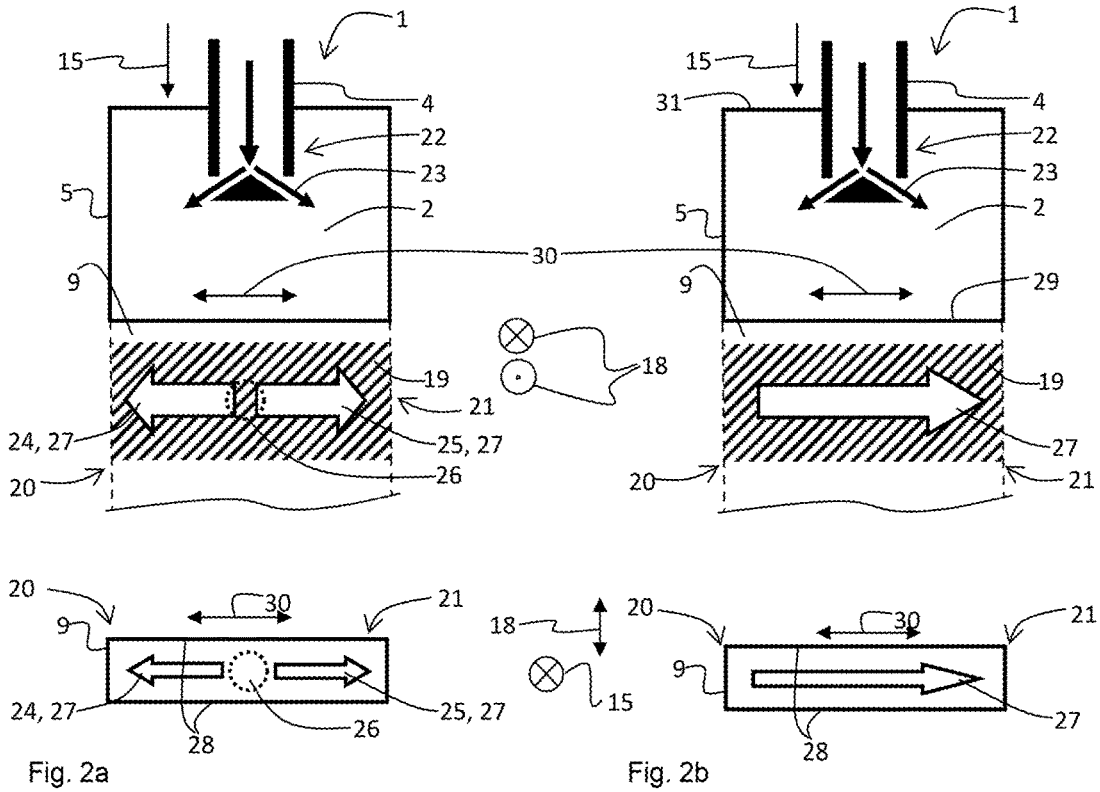

FIG. 2*a* is a schematic sectional view of an example device for the continuous casting of thin slabs in a region of a mold and underneath the mold, wherein an electromagnetic field is divided into two subfields.

FIG. 2*b* is a schematic sectional view of an example device for the continuous casting of thin slabs in a region of a mold and underneath the mold, wherein an electromagnetic field is not divided into two subfields.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

An object of the present invention is to provide a method and a device for producing thin slabs by the continuous casting method which, in spite of short solidifying-through times and comparatively small-volume proportions of liquid inside the strand, make it possible to produce a large core zone with a fine-grained, globular microstructure in the thin-slab strand, in order to prevent the disadvantages that are caused in the prior art by a coarse, highly directional, columnar crystalline microstructure in the thin-slab strand. Furthermore, the risk of immersion tube clogging due to overheating being too low is to be avoided.

This object is achieved by a method for the continuous casting of thin slabs comprising the steps of: feeding a molten metal into a mold, molding a partially solidified thin-slab strand from the molten metal in the mold, reducing the flow rate of the molten metal in the partially solidified thin-slab strand by means of an electromagnetic brake (EMBR) arranged in the region of the mold and removing the partially solidified thin-slab strand from the mold by means of a strand guiding system, unsolidified parts of the partially solidified thin-slab strand being stirred by means of an electromagnetic stirrer arranged underneath the mold downstream along the strand takeoff direction of the thin-slab strand, a traveling electromagnetic field being produced by means of the electromagnetic stirrer in a region of the thin-slab strand that is at a distance from the mold of between 20 and 7000 millimeters along the strand takeoff direction.

The device according to the invention has the advantage over the prior art that a refinement of the solidification structure inside the thin-slab strand is achieved by a conception for the electromagnetic stirring that is specifically designed for the continuous casting of thin slabs and that the increase in the flow rate of the molten steel in the region of the mold that is induced by the stirrer is prevented from leading to inadmissibly strong local fluctuations in the bath level, i.e. fluctuations in the bath level of for example more than 15 mm, by the use at the same time of an electromagnetic brake. Great turbulence in the bath level may lead to strand ruptures or to strand surface defects due to casting slag being entrapped at the bath level of the mold. Both strand ruptures and strand surface defects are intended to be avoided. It has surprisingly been found that the electromagnetic stirring at a distance of 20 to 7000 millimeters underneath the mold, and in particular from the underside of the mold, brings about an accelerated and uniform reduction of the overheating, which advantageously leads to the formation of a sufficiently large core zone, i.e. in particular at least 30% in the direction of the thickness, with a fine-grained, globular microstructure inside the thin-slab strand, while coarse, columnar crystalline structures are limited by the stirring. In spite of the short solidifying-through times that are typical in the case of continuous casting of thin slabs and small-volume proportions of liquid inside the thin-slab strand, this fine-grained, globular core zone forms in the solidification structure, whereby the occurrence of columnar crystals between the outer zone and the central region of the strand is greatly reduced. The extent of the globular core zone in the thickness direction is then in particular at least 30%. Consequently, in the product produced, longitudinal striations, microstructural stringers, core segregations and internal crack susceptibilities can be reduced and the HIC resistance and the homogeneity of the mechanical and magnetic properties can be increased. Furthermore, a higher, uncritical overheating can be advantageously retained, so that the risk of casting problems in the form of immersion tube clogging and resultant strand surface defects or strand ruptures can be eliminated. It is conceivable that, in the case of the present method, an overheating of the molten steel in the tundish of between 10 and 50 kelvins, preferably around 20 kelvins, is used for example. By means of the electromagnetic stirrer, a traveling electromagnetic field is generated in a region of the thin-slab strand that is at a distance from the mold of between 20 and 7000 millimeters along the strand takeoff direction. For the purposes of the present invention, a region of the thin-slab strand that is at a distance from the mold of between 20 and 7000 millimeters is to be understood as meaning in particular that region of the thin-slab strand that is at a distance from the underside of the mold of between 20 and 7000 millimeters. Alternatively, the position of the electromagnetic stirrer and the traveling electromagnetic field in relation to the mold could also be defined by the distance from the bath level in the mold, which is typically around 100 millimeters underneath the upper side of the mold. The electromagnetic stirrer is preferably arranged in such a way that the traveling field directly underneath the mold acts on the not yet solidified parts of the strand, since, with parts of the strand already solidified, positive influencing of the grain microstructure by the traveling field is no longer possible. The traveling electromagnetic field is preferably generated in a region that is at a distance from the mold or from the underside of the mold of between 50 and 3000 millimeters along the strand takeoff direction. It is also conceivable to define the position of the electromagnetic stirrer or of the traveling electromagnetic field along the strand takeoff direction by the distance from the bath level in the mold: the distance from the bath level along the strand takeoff direction preferably comprises between 0.9 and 3.8 meters and preferably between 1.5 and 2.5 meters. For the purposes of the present invention, in particular either a single electromagnetic stirrer is arranged on one side of the thin-slab strand, either on the fixed side or the loose side, or a separate electromagnetic stirrer is arranged on each side, i.e. both on the fixed side and on the loose side. The fixed side refers here in particular to that broad side of the strand guiding segments that always remains unchanged in its position and serves as a so-called reference line. Adaptations of the strand thickness formats are then always made by modifying the opposite loose side. The method according to the invention is used in particular for producing thin slabs by the continuous casting method and hot strip or cold strip produced therefrom. The hot strip or cold strip is used in particular for producing electric sheets (not grain-oriented or grain-oriented) or sheets of higher-strength steels with yield strength values greater than 400 megapascals (for example heat-treatable steel). For the purposes of the present invention, a thin slab comprises in particular a slab with a thickness of between 40 and 120 millimeters. For a precise description of the geometrical conditions, mention is made hereinafter not only of the strand takeoff direction but also of two transverse directions, a first transverse direction and a second transverse direction. The first transverse direction in this case always runs perpendicularly to the strand takeoff direction and parallel to the strand surface normal of the slab broad side, while the second transverse direction always runs perpendicularly to the strand takeoff direction and parallel to the strand surface on the slab broad side. The slab broad side should be understood here as meaning that side of the rectangular cross section of the thin-slab strand that has the greater extent. The first and second transverse directions consequently both run perpendicularly to the strand takeoff direction, and also perpendicularly to one another.

According to a preferred embodiment of the present invention, it is provided that, within the mold and/or during the removal of the partially solidified thin-slab strand from the mold by the strand guiding system, the unsolidified parts are stirred by means of the electromagnetic stirrer, which is positioned underneath the mold. It is thereby ensured in an advantageous way that during the stirring the proportion of not yet solidified molten metal inside the thin-slab strand is still sufficiently great, i.e. at least 50% of the strand thickness, to obtain a core zone of the largest possible cross-sectional surface area with a fine-grained, globular microstructure, i.e. to obtain a globular core zone with an extent in the thickness direction of the slab of at least 30%.

According to a further preferred embodiment of the present invention, it is provided that the electromagnetic stirrer is set in such a way that, along a second transverse direction, which runs perpendicularly to the strand takeoff direction and parallel to a strand surface on a broad side of the thin-slab strand, the traveling electromagnetic field runs from a first outer region of the thin-slab strand to a second outer region of the thin-slab strand that is opposite from the first outer region. In this way, a stirring up of the not yet solidified molten metal in the thin-slab strand is achieved, so that when it solidifies fine, globular grains form in the solidification structure. The traveling electromagnetic field is preferably reversed after the elapse of a time period of 1 to 60 seconds, particularly preferably between 1 and 10 seconds, so that the traveling electromagnetic field subsequently runs along the second transverse direction from a second outer region of the thin-slab strand to the first outer region of the thin-slab strand. After a renewed elapse of the time period of 1 to 60 seconds, preferably once again 1 to 10 seconds, the traveling electromagnetic field is again reversed and the cycle starts from the beginning.

According to an alternative preferred embodiment of the present invention, it is provided that a bidirectional, symmetrical traveling electromagnetic field is generated over the width of the thin-slab strand by means of the electromagnetic stirrer, the electromagnetic stirrer being set in such a way that a first subfield of the traveling electromagnetic field runs from the center of the thin-slab strand to a first outer region of the thin-slab strand and that a second subfield of the traveling electromagnetic field runs from the center to a second outer region of the thin-slab strand that is opposite from the first outer region. Preferably, this traveling electromagnetic field is maintained for 1 to 60 seconds, particularly preferably between 1 and 10 seconds. After that, the traveling electromagnetic field generated by the electromagnetic stirrer, and consequently the direction of the two subfields, is reversed. This reversed traveling electromagnetic field is likewise maintained preferably for between 1 and 60 seconds and particularly preferably between 1 and 10 seconds. After that, the traveling electromagnetic field is once again reversed and the cycle starts from the beginning. This preferred embodiment provides symmetrical stirring up of the not yet solidified molten metal within the already solidified outer zone of the thin-slab strand, so that a symmetrical solidification structure with fine, globular grains occurs.

According to a further alternative preferred embodiment of the present invention, it is provided that a bidirectional, symmetrical traveling electromagnetic field is generated over the width of the thin-slab strand by means of the electromagnetic stirrer, the electromagnetic stirrer being set in such a way that a first subfield of the traveling electromagnetic field runs from a first outer region of the thin-slab strand to the center of the thin-slab strand and that a second subfield of the traveling electromagnetic field runs from a second outer region of the thin-slab strand that is opposite from the first outer region to the center of the thin-slab strand. Preferably, this traveling electromagnetic field is maintained for 1 to 60 seconds, in particular between 1 and 10 seconds. After that, the traveling electromagnetic field generated by the electromagnetic stirrer, and consequently the direction of the two subfields, is reversed. This reversed traveling electromagnetic field is likewise maintained for between 1 and 60 seconds, in particular between 1 and 10 seconds. After that, the traveling electromagnetic field is once again reversed and the cycle starts from the beginning. This preferred embodiment likewise provides symmetrical stirring up of the not yet solidified molten metal within the already solidified outer zone of the thin-slab strand, so that a symmetrical solidification structure with fine, globular grains occurs.

According to a further preferred embodiment of the present invention, it is provided that a traveling electromagnetic field of which the magnetic flux density is on average preferably 0.1 to 0.6 tesla, particularly preferably 0.3 to 0.5 tesla and most particularly preferably substantially 0.4 tesla, is generated over the width of the thin-slab strand by means of the electromagnetic stirrer. It has been found that an alternating field with amplitudes in the range of preferably 0.1 to 0.6 tesla, particularly preferably 0.3 to 0.5 tesla and most particularly preferably substantially 0.4 tesla, is sufficient to achieve an accelerated and uniform reduction of the overheating in the molten metal. This effect is advantageously achieved by an electromagnetic stirrer set in such a way that the flow rate of the unsolidified parts in the partially solidified thin-slab strand is at most 0.7 meters per second or at least 0.2 meters per second and preferably between 0.2 and 0.7 meters per second. The accompanying circulation of the unsolidified parts in the thin-slab strand provides the accelerated and uniform reduction of the overheating, and as a result the desired microstructural refinement, without an overheating that is lower from the outset having to be chosen, that would have the effect of drastically increasing the risk of immersion tube clogging.

According to a further preferred embodiment of the present invention, it is provided that the electromagnetic stirrer is set in such a way that the stirring frequency is at least 0.1 Hz or at most 10 Hertz and preferably between 1 and 10 Hz. It has been found that this stirring frequency range is particularly advantageous. With a stirring frequency of less than 0.1 Hz, there is no traveling electromagnetic field, so that no stirring action occurs. If the stirring frequency is greater than 10 Hz, the depth of penetration of the traveling electromagnetic field into the interior of the strand is too small and no microstructural refinement is achieved.

According to a further preferred embodiment of the present invention, it is provided that an electromagnetic field of which the magnetic flux density is preferably 0.1 to 0.3 tesla, particularly preferably 0.15 to 0.25 tesla and most particularly preferably substantially 0.2 tesla, is generated within the mold by means of the electromagnetic brake. This advantageously has the effect that the flow rate of the molten metal between the partially solidified outer regions of the strand is braked, and consequently fluctuations in the casting level, and also surface defects resulting from fluctuations in the casting level (so-called shell defects) and internal defects (for example casting slag inclusions), are prevented.

According to a further preferred embodiment of the present invention, it is provided that the magnetic field strengths of the traveling electromagnetic field caused by the electromagnetic stirrer and of the field caused by the electromagnetic brake are made to match one another. It has been found that a matching of the magnetic field strengths of the traveling electromagnetic field caused by the electromagnetic stirrer and of the field caused by the electromagnetic brake is advantageous. The matching preferably takes place by the magnetic field strength of the field of the electromagnetic brake being raised by 20 to 80% of its base value to values of between 0.1 and 0.3 tesla when the electromagnetic stirrer is included. Understood as the base value in this connection is the magnetic field strength of the field of the electromagnetic brake as it is typically used without the additional use of an electromagnetic stirrer. Typical basic settings for an electromagnetic brake without the use of an electromagnetic stirrer are fields with magnetic field strengths of between 0.08 and 0.2 tesla.

A further subject of the present invention for achieving the object mentioned at the beginning is a device for the continuous casting of thin slabs, in particular by using the method according to the invention, which has a feeding means for supplying a molten metal, a mold for molding a partially solidified thin-slab strand from the molten metal, an electromagnetic brake, arranged in the region of the mold, for reducing the flow rate of the molten metal inside the partially solidified strand within the mold and a strand guiding system for removing the partially solidified thin-slab strand from the mold, the device also comprising an electromagnetic stirrer, arranged underneath the mold downstream along the strand takeoff direction of the thin-slab strand, for stirring unsolidified parts of the partially solidified thin-slab strand, the electromagnetic stirrer being at a distance from the mold of between 20 and 7000 millimeters along the strand takeoff direction.

The device according to the invention has the advantage over the prior art that the molten metal is stirred by the electromagnetic stirrer during the continuous casting, whereby the refinement of the solidification structure inside the thin-slab strand is achieved. The stirring of the molten metal provides an accelerated and uniform reduction of the overheating, which advantageously leads to the formation of a core zone with a fine-grained, globular microstructure inside the thin-slab strand, while coarse columnar crystalline structures are broken up by the stirring. In spite of the short solidifying-through times that are typical in the case of continuous casting of thin slabs and small-volume proportions of liquid inside the thin-slab strand, this fine-grained, globular core zone forms in the solidification structure, whereby the occurrence of columnar crystals between the outer zone and the central region of the strand is avoided or at least suppressed. The products produced from the thin slabs consequently have significantly reduced longitudinal striations, microstructural stringers and internal crack susceptibilities, and also increased HIC resistance and homogeneity of the mechanical and magnetic properties. The electromagnetic stirrer generates in particular a spatially and/or temporally variable magnetic field in the region of the thin-slab strand. The electromagnetic stirrer preferably comprises a linear field stirrer, which is arranged on one of the two broad sides of the thin-slab strand. It would also be conceivable however that a linear field stirrer is arranged on each of both opposite broad sides of the thin-slab strand. Alternatively, the electromagnetic stirrer comprises a rotary field stirrer or a helicoidal stirrer.

The electromagnetic stirrer is arranged underneath the electromagnetic brake along the strand takeoff direction of the thin-slab strand. In an advantageous way, a rapid and uniform reduction of the overheating is thereby achieved in the not yet solidified parts of the thin-slab strand before the solidification advances into the interior of the thin-slab strand, so that the refinement of the solidification structure is achieved. In principle, the proportion of the globular core zone in the thin slab is all the greater the closer the electromagnetic stirrer is arranged to the meniscus of the thin-slab strand or to the bath level. At the same time, however, it must be ensured that the electromagnetic stirrer is also effective in the lower region of the mold, in order that an early and rapid reduction of the overheating is achieved in the strand interior, and the flows in the molten metal that are produced by the electromagnetic stirrer do not lead to increased fluctuations in the bath level and to increased local excessive bath levels in the mold. It has been found that, for this, the electromagnetic stirrer should be advantageously arranged at a distance from the mold and in particular from the underside of the mold of 20 to 7000 millimeters and preferably 50 to 3000 millimeters along the strand takeoff direction. To put it another way: the distance between the electromagnetic stirrer and the bath level preferably comprises between 0.9 and 3.8 meters and preferably between 1.5 and 2.5 meters. It is also provided in particular that the electromagnetic stirrer is at a distance from a surface of the thin-slab strand of 20 to 1000 millimeters, preferably 20 to 200 millimeters and particularly preferably 20 to 40 millimeters, along the first transverse direction.

The device according to the invention serves in particular for producing thin slabs by the continuous casting method and hot strip or cold strip produced therefrom. The hot strip or cold strip is used in particular for producing electric sheets (not grain-oriented or grain-oriented) or sheets of higher-strength steels with yield strength values greater than 400 megapascals (for example heat-treatable steel). For the purposes of the present invention, a thin slab comprises in particular a slab with a thickness of between 40 and 120 millimeters.

According to a further preferred embodiment of the present invention, it is provided that the electromagnetic stirrer comprises a linear field stirrer for generating a traveling electromagnetic field in the region of the thin-slab strand, the running direction of the traveling electromagnetic field being aligned parallel to the second transverse direction. The electromagnetic stirrer is in particular configured in such a way that a first subfield of the traveling electromagnetic field runs from the center of the thin-slab strand to a first outer region of the thin-slab strand and a second subfield of the traveling electromagnetic field runs from the center to a second outer region of the thin-slab strand that is opposite from the first outer region. This traveling electromagnetic field is maintained for between 1 and 60 seconds, preferably between 1 and 10 seconds. After that, it is reversed, so that the first subfield runs from the first outer region of the thin-slab strand and the second subfield runs from the second outer region of the thin-slab strand that is opposite from the first outer region to the center of the thin-slab strand. This field is also maintained for between 1 and 60 seconds, preferably between 1 and 10 seconds. After that, the cycle starts again from the beginning. In an advantageous way, a uniform and symmetrical flow inside the strand, and consequently also a uniform removal of the overheating, are thereby achieved. On the one hand, a homogeneous microstructural refinement inside the strand and on the other hand a uniform growth of the strand shell over the width of the strand are intended to be brought about as a result. In this way it is prevented that strand ruptures or longitudinal surface cracks occur.

According to a further preferred embodiment of the present invention, it is provided that the electromagnetic stirrer is set in such a way that the flow rate of the molten metal that is produced by the stirrer is at least 0.2 meters per second or at most 0.7 meters per second and in particular is between 0.2 and 0.7 meters per second. In this way it is ensured that on the one hand the growth of the strand shell on the strand narrow side is not weakened too much (reduction of the risk of strand rupture) and on the other hand strong element depletions (so-called white bands, i.e. depletion of C, Mn, Si, P, S, etc.) at the solidification front in the area of action of the stirrer are avoided. It has been found that the flow rate should not be less than 0.2 meters per second, because otherwise a sufficient microstructural refinement cannot be achieved. A globular core zone of which the extent in the thickness direction is less than 30% may for example be regarded as not adequate. The flow rate should also not be greater than 0.7 meters per second, in order to avoid a depletion of the molten alloying elements in the region of the solidification front. The depletion of the molten alloying elements in the region of the solidification front is measurable in the solidified material. This phenomenon is referred to as "white bands" or "white lines". White bands lead to inhomogeneous properties of the end product.

According to a further preferred embodiment of the present invention, it is provided that, in the upper half of the mold, the electromagnetic brake is at a distance from a surface of the thin-slab strand of 20 to 150 millimeters, preferably 25 to 100 millimeters and particularly preferably substantially 75 millimeters, along the first transverse direction. For the purposes of the present invention, the aforementioned distance is to be understood in particular as meaning the smallest distance between the electromagnetic brake and the strand surface.

With reference now to the figures, those having ordinary skill in the art will understand that details, features and advantages of the present disclosure will emerge from the figures and from the following description of the examples in the figures. Thus, it should likewise be understood that the figures merely illustrate examples of the present disclosure and do not restrict the scope of the present disclosure.

In FIG. 1, a schematic view of a sectional image of a device 1 for producing thin slabs by the continuous casting method according to an exemplary embodiment of the present invention is represented.

In the present example, molten metal 2 from a steel casting ladle 6 is transferred into a tundish 3 and cast from the distributor 3 by way of a casting tube 4 (feeding means) into a mold 5 of the device 1. The flow through the casting tube is controlled in dependence on the casting level 7 in the mold 5 by a plug 8 or a slide. The mold 5 comprises a mold with a downwardly open through-opening of a rectangular cross section. The broad sides 28 of the mold are spaced apart by between 40 and 120 millimeters, in order that the mold 5 is suitable for the casting of thin slabs. The mold consists of water-cooled copper plates, which have the effect of solidifying the supplied molten metal in the outer region of the mold 5. Consequently, a thin-slab strand 9 with a solidified shell 10 and a mostly not yet solidified cross section 11 within the solidified shell 10 forms in the mold 5 from the continuously supplied molten metal 2. Optionally, the mold 5 oscillates, in order that the surface of the strand is prevented from becoming attached to the mold 5. The thin-slab strand 9 runs through the mold 5 along a vertical strand takeoff direction 15. When it leaves the downwardly open mold 5, the thin-slab strand 9 is taken up by a transporting system 12 (also referred to as the strand guiding system) with a multiplicity of strand guiding rollers 13 and is passed through a so-called casting bow 14. The thin-slab strand 9 is thereby cooled down until it has solidified through completely.

Apart from the strand takeoff direction 15, a first transverse direction 18 and a second transverse direction 30 are sketched in FIG. 1. The first transverse direction 18 in this case runs perpendicularly to the strand takeoff direction 15 and parallel to a strand surface normal of the slab broad side 28 (in FIG. 1, the slab broad side 28 extends into the plane of the drawing), while the second transverse direction 30 runs perpendicularly to the strand takeoff direction 15 and parallel to the strand surface on the slab broad side 28, i.e. therefore perpendicularly to the first transverse direction 18.

Arranged in the upper region of the mold 5 is an electromagnetic brake 16 (EMBR), which slows down the flow rate of the molten metal 2 inside the already partially solidified thin-slab strand 9 and thereby reduces fluctuations in the bath level in the mold 5. In the present example, the electromagnetic brake 16 comprises two coils arranged on either side of the thin-slab strand 9. An electromagnetic field of which the magnetic flux density is preferably 0.1 to 0.3 tesla, and particularly preferably substantially 0.2 tesla, is generated within the mold 5 by the electromagnetic brake 16. The braking of the flow rate of the molten metal 2 between the partially solidified outer regions 10 of the thin-slab strand 9 has the effect that fluctuations in the casting level, and also surface defects resulting from fluctuations in the casting level (so-called shell defects) and internal defects (for example casting slag inclusions), can be prevented.

Underneath the mold 5, the device 1 according to the invention comprises an electromagnetic stirrer 17 for stirring unsolidified parts of the partially solidified thin-slab strand 9. In the present example, the electromagnetic stirrer 17 comprises a linear field stirrer, which extends along one of the two broad sides 28 of the strand. The linear field stirrer generates over the width of the thin-slab strand 9 a traveling electromagnetic field 19 (see FIGS. 2*a* and 2*b*), which cyclically runs back and forth between a first outer region 20 of the thin-slab strand 9 and an opposite second outer region 21 of the thin-slab strand 9 along a second transverse direction 30, which is perpendicular to the strand takeoff direction 15 and parallel to the broad side 28 of the strand surface. The traveling electromagnetic field 19 is generated in a region that is at a distance from the mold 5 or from the underside 29 of the mold of between 20 and 7000 millimeters, preferably between 50 and 3000 millimeters, along the strand takeoff direction 15 and comprises on average a magnetic flux density of between 0.1 and 0.6 tesla and preferably of substantially 0.4 tesla. The traveling electromagnetic field leads to a stirring of the molten metal, whereby an accelerated and uniform reduction of the overheating in the molten metal is brought about. This advantageously leads to the formation of a larger core zone with a fine-grained, globular microstructure inside the thin-slab strand 9, while coarse columnar crystalline structures are restricted by the electromagnetic stirring. This effect is advantageously achieved by an electromagnetic stirrer 17 that is set in such a way that the flow rate of the unsolidified parts in the partially solidified thin-slab strand is less than 0.7 meters per second and preferably between 0.2 and 0.7 meters per second. In spite of the short solidifying-through times that are typical in the case of continuous casting of thin slabs and small-volume proportions of liquid inside the thin-slab strand 9, the fine-grained, globular core zone then forms in the solidification structure, whereby the occurrence of columnar crystals between the outer zone and the central region of the thin-slab strand 9 is suppressed. Consequently, in an end product produced from the continuously cast thin slabs, longitudinal striations, microstructural stringers, core segregations and internal crack susceptibilities can be reduced and the HIC resistance and the homogeneity of the mechanical and magnetic properties can be increased. In the present case, casting is performed for example with an overheating, i.e. a temperature difference of the actual temperature of the molten material minus the liquidus temperature, of between 10 and 50 kelvins, preferably around 30 kelvins. Therefore, a higher, uncritical overheating can be retained, so that the risk of casting problems in the form of immersion tube clogging and resultant strand surface defects or strand ruptures is eliminated.

With the device described above and the method described above, thin slabs are produced, in particular for hot strip or cold strip. Hot strip or cold strip is used in particular for producing electric sheets (not grain-oriented or grain-oriented) or sheets of higher-strength steels with yield strength values greater than 400 megapascals (for example heat-treatable steel).

In FIGS. 2*a* and 2*b*, schematic views of details of the device 1 for the continuous casting of thin slabs in the region of the mold and underneath the mold according to the exemplary embodiment of the present invention explained above on the basis of FIG. 1 are represented. In the upper region of FIGS. 2*a* and 2*b* there is respectively illustrated a view of a sectional image along a sectional image plane parallel to the strand takeoff direction 15 and a plane parallel to the second transverse direction 30. In the lower region of FIGS. 2*a* and 2*b* there is respectively illustrated a view of a sectional image along a sectional image plane perpendicular to the strand takeoff direction 15, i.e. to the first transverse direction 18 and to the second transverse direction 30, in the region of the electromagnetic stirrer 17, which corresponds to the cross section of the strand 9.

It can be seen in each case from the upper figure that the feeding means comprises the casting tube 4, which is immersed in the molten metal 2 located in the mold 5, and, underneath the casting level 7, discharge holes 22 formed on the casting tube 4 in the lower part of the casting tube 4. The molten metal 2 is introduced by means of the discharge holes 22 at an angle to the strand takeoff direction 15 of the thin-slab strand 9 (see flow arrows 23). Arranged underneath the mold 5 is the traveling electromagnetic field 19, induced by the electromagnetic stirrer 17 that is not represented. The electromagnetic stirrer 17, which is arranged underneath the mold 5, generates underneath the mold 5 the traveling electromagnetic field 19, which in turn brings about flows that can extend into the mold 5—under some circumstances even up to the bath level. In the case of the exemplary embodiment according to FIG. 2*a*, the electromagnetic stirrer 17 is configured in such a way that the traveling electromagnetic field 19 comprises two subfields, a first subfield 24 and a second subfield 25. The first subfield 24 of the traveling electromagnetic field 19 cyclically migrates back and forth between a center 26 of the thin-slab strand 9 and the first outer region 20 of the thin-slab strand 9, while the second subfield 25 of the traveling electromagnetic field 19 cyclically migrates back and forth between the center 26 and the second outer region 21 of the thin-slab strand 9. The movement of the traveling electromagnetic field 19 is schematically represented by the movement arrows 27. The dividing of the traveling electromagnetic field 19 into two bidirectional, symmetrical subfields leads to a uniform and symmetrical flow inside the thin-slab strand 9, and consequently also to a rapid and uniform removal of the overheating. On the one hand, a homogeneous microstructural refinement inside the strand and on the other hand a uniform growth of the strand shell over the width of the strand are intended to be brought about as a result. In this way the potential risk of a strand rupture or longitudinal surface cracks occurring is prevented due to the electromagnetic stirring. The electromagnetic stirrer 17 is preferably also set in such a way that the flow rate of the molten metal produced by the stirrer at the solidification front is between 0.2 and 0.7 meters per second. In this way it is ensured that on the one hand the growth of the strand shell on the strand narrow side is not weakened too much (reduction of the risk of strand rupture) and on the other hand strong element depletions (so-called white bands, i.e. depletion of C, Mn, Si, P, S, etc.) at the solidification front in the area of action of the electromagnetic stirrer 17 are avoided. Moreover, the electromagnetic stirrer 17 must be set in such a way that the flows in the molten metal 2 that are produced by the electromagnetic stirrer 17 do not lead to increased fluctuations in the bath level and to increased local excessive bath levels in the mold 5. In this case, the magnetic field strengths of the electromagnetic stirrer 17 and of the electromagnetic brake 16 should be made to match one another. The matching takes place for example by the magnetic field strength of the electromagnetic brake 16 being raised by 20 to 80% of its base value to values of between 0.1 and 0.3 tesla when the electromagnetic stirrer 17 is included. Understood as the base value in this connection is the magnetic field strength of the electromagnetic brake 16 as it is typically used without the additional use of an electromagnetic stirrer 17. Typical basic settings for an electromagnetic brake 16 without the use of an electromagnetic stirrer 17 are 0.08 to 0.2 tesla.

In the lower representation of FIG. 2*a*, the rectangular cross section of the through-opening of the mold 5 can be schematically seen. The traveling electromagnetic field 19 or the two subfields 24, 25 migrate through the thin-slab strand 9 along the broad sides 28.

Alternatively, the traveling electromagnetic field 19 is not divided into two subfields 24, 25, but cyclically runs along the second transverse direction 30 back and forth between the first outer region 20 of the thin-slab strand 9 and the opposite second outer region 21 of the thin-slab strand 9. This exemplary embodiment is illustrated by way of example in FIG. 2*b*.

The following exemplary embodiments were carried out with a device according to FIGS. 1 and 2*a*.

Exemplary Embodiment 1

A measure of the success of the refinement of the solidification structure inside the thin-slab strand is the proportion of the globular core zone (GCZ). The extent of the globular core zone in percent is defined as GCZ (%)=$D_{GCZ}$ (mm)/D (mm)·100 where $D_{GCZ}$=the thickness of the globular core zone and D=the slab thickness.

A test was therefore carried out with the steel grade S420MC, a casting rate of 5 meters per minute, an overheating in the tundish of 30 kelvins, a strand thickness of 65 millimeters, a strand width of 1550 millimeters and a mold height of 1100 millimeters, in which the electromagnetic brake (EMBR) was arranged in the upper half of the mold and the electromagnetic stirrer (EMS) was arranged underneath the mold, downstream of a magnetic rollers of the transporting system. The electromagnetic stirrer or the alternating electromagnetic field of the electromagnetic stirrer was arranged at a distance of 2960 millimeters from the casting level. The results presented in the following table were thereby achieved:

| Ex. | | Magnetic field strength (T) | Distance from the strand surface (mm) | GCZ (%) EMBR only | GCZ (%) EMBR + EMS |
|---|---|---|---|---|---|
| 1 | EMBR | 0.1 | 75 | 0-10 | 40-50 |
| | EMS | 0.1 | 310 | | |
| 2 | EMBR | 0.2 | 75 | 0-10 | 50-60 |
| | EMS | 0.4 | 310 | | |

The series of tests demonstrate that the inclusion of an electromagnetic stirrer arranged underneath the mold has the effect that the proportion of the globular core zone (GCZ) of 0 to 10 percent increases to a proportion of 40 to 60 percent.

Exemplary Embodiment 2

A connection between overheating of the molten steel in the tundish and the proportion of the globular core zone on the one hand and the resultant longitudinal striations on the finished strip in the case of dynamo steels and the core segregation was experimentally determined on dynamo steels with 2.4% silicon:

| Overheating (K) | GCZ in thickness direction (%) | Longitudinal striations on the finished cold-rolled strip | Core segregation |
|---|---|---|---|
| 37 | 0 | severe | moderate |
| 24 | 3 | severe | moderate |
| 11 | 6 | moderate-severe | moderate |
| 6 | 30 | mild-moderate | mild-moderate |
| 3 | 50-70 | none | none |

It follows from this that, to avoid longitudinal striations and to reduce the core segregation, the proportion of the globular core zone (GCZ) should be at least 30 percent and preferably greater than 50 percent. An overheating of less than 20 K should be avoided however, since otherwise problems in the form of clogging of the immersion tubes in the mold would occur, which may result in strand surface defects or even strand ruptures.

It is shown below by the example of the dynamo steel with 2.4% silicon and thin slabs with a thickness of 63 millimeters, an overheating in the tundish of 30 kelvins, a strand width of 1550 millimeters and a mold height of 1100 millimeters; the casting level lay 1000 millimeters above the underside of the mold, the stirring frequency was 6 Hz, the flow rate at the solidification front was 0.4 m/s; that, by appropriate choice of the distance between the casting level and the electromagnetic stirrer (EMS), the required proportion of the globular core zone (GCZ) of at least 30 percent and preferably at least 50 percent can be achieved with different casting rates $V_G$:

| GCZ (%) | Strand shell thickness "S" on the respective broad side (mm) | Distance of the EMS from the bath level (m) $V_G = 4.0$ m/min | $V_G = 5.0$ m/min | $V_G = 6.0$ m/min |
|---|---|---|---|---|
| 30 | 22 | 4.8 | 6.1 | 7.3 |
| 40 | 19 | 3.6 | 4.5 | 5.4 |
| 50 | 16 | 2.6 | 3.2 | 3.8 |
| 60 | 13 | 1.7 | 2.1 | 2.5 |

The above series of measurements show that, with the casting rates ($V_G$) customary for thin-slab continuous casting installations of between 4 and 6 m/min, for a proportion of the globular core zone of 50 percent the electromagnetic stirrer must be arranged between 2.6 and 3.8 meters underneath the bath level of the mold, for a proportion of 60 percent between 1.7 and 2.5 meters. Satisfactory results are however also already achieved with a distance of the electromagnetic stirrer from the bath level of between 3.6 and 7.3 meters.

The distance between the mold or the underside of the mold and the electromagnetic stirrer consequently is advantageously between 20 and 7000 millimeters and preferably between 50 and 3000 millimeters. Alternatively, it is also evident that a distance between 100 and 7000 millimeters, between 500 and 6500 millimeters, between 700 and 6300 millimeters, between 700 and 4400 millimeters or between 700 and 2800 millimeters is particularly advantageous.

What is claimed is:

1. A method for continuous casting of thin slabs, the method comprising:

feeding a molten metal into a mold;

molding a partially solidified thin-slab strand from the molten metal in the mold;

reducing a flow rate of the molten metal in the partially solidified thin-slab strand by using an electromagnetic brake disposed in a region of the mold;

removing the partially solidified thin-slab strand from the mold by a strand guiding system; and stirring unsolidified parts of the partially solidified thin-slab strand using an electromagnetic stirrer disposed beneath the mold downstream along a strand takeoff direction of the thin-slab strand, wherein the electromagnetic brake is located in the upper half of the mold and the electromagnetic stirrer is disposed a distance from the bath level in the mold of between 0.9-2.1 meters along the strand takeoff direction and produces a traveling electromagnetic field in a region of the thin-slab strand.

2. The method of claim 1 wherein the electromagnetic field is generated in a region of the thin-slab strand that is at a distance from the mold of between 50-3000 millimeters along the strand takeoff direction.

3. The method of claim 1 wherein the electromagnetic brake generates an electromagnetic field within the mold, wherein in an upper half of the mold the electromagnetic brake is at a distance from a surface of the thin-slab strand of between 20-150 millimeters along a first transverse direction that runs perpendicular to the strand takeoff direction and parallel to a strand surface normal on a broad side of the thin-slab strand.

4. The method of claim 3 wherein the electromagnetic stirrer is configured such that along a second transverse direction that runs perpendicular to the strand takeoff direction and perpendicular to the first transverse direction the traveling electromagnetic field runs from a first outer region of the thin-slab strand to a second outer region of the thin-slab strand that is opposite the first outer region.

5. The method of claim 4 further comprising reversing the traveling electromagnetic field after 1 to 60 seconds in such a way that the traveling electromagnetic field runs along the second transverse direction from the second outer region of the thin-slab strand to the first outer region of the thin-slab strand.

6. The method of claim 1 wherein the traveling electromagnetic field is a bidirectional, symmetrical traveling electromagnetic field that extends over a width of the thin-slab strand, wherein a first subfield of the traveling electromagnetic field runs from a center of the thin-slab strand to a first outer region of the thin-slab strand and a second subfield of the traveling electromagnetic field runs from the center of the thin-slab strand to a second outer region of the thin-slab strand that is opposite the first outer region.

7. The method of claim 6 further comprising reversing the traveling electromagnetic field after 1 to 60 seconds such that the first subfield runs from the first outer region of the thin-slab strand to the center of the thin-slab strand and the second subfield runs from the second outer region of the thin-slab strand to the center of the thin-slab strand.

8. The method of claim 1 wherein the traveling electromagnetic field is a bidirectional, symmetrical traveling electromagnetic field that extends over a width of the thin-slab strand, wherein a first subfield of the traveling electromagnetic field runs from a first outer region of the thin-slab strand to a center of the thin-slab strand and a second subfield of the traveling electromagnetic field runs from a second outer region of the thin-slab strand that is opposite the first outer region to the center of the thin-slab strand.

9. The method of claim 8 further comprising reversing the traveling electromagnetic field after 1 to 60 seconds such that the first subfield runs from the center of the thin-slab strand to the first outer region and the second subfield runs from the center of the thin-slab strand to the second outer region.

10. The method of claim 1 wherein the traveling electromagnetic field generated in the region of the thin-slab strand has a magnetic flux density of on average 0.1 to 0.6 tesla.

11. The method of claim 1 wherein the electromagnetic stirrer is configured such that a flow rate of the unsolidified parts of the partially solidified thin-slab strand is between 0.2 and 0.7 meters per second.

12. The method of claim 1 wherein the electromagnetic stirrer is configured such that a stirring frequency is between 0.1 and 10 Hz.

13. The method of claim 1 wherein an electromagnetic field generated within the mold by the electromagnetic brake has a magnetic flux density of 0.1 to 0.3 tesla.

14. The method of claim 1 further comprising producing thin slabs with a thickness of 40 to 120 millimeters.

15. The method of claim 1 further comprising producing thin slabs for production of hot strip or cold strip for producing electric sheets or sheets of high-strength steel having a yield strength value of more than 400 megapascals.

* * * * *